United States Patent [19]

Baker et al.

[11] Patent Number: 4,635,712

[45] Date of Patent: Jan. 13, 1987

[54] HEAT EXCHANGER ASSEMBLY FOR A COMPRESSOR

[76] Inventors: Robert L. Baker, 139 Brompton Rd., Williamsville, N.Y. 14221; Diane E. Glauber, 65 Little Robin Rd., Amherst, N.Y. 14228

[21] Appl. No.: 716,866

[22] Filed: Mar. 28, 1985

[51] Int. Cl.[4] ..... F28F 9/02

[52] U.S. Cl. ..... 165/82; 165/70

[58] Field of Search ..... 165/70, 82

[56] References Cited

U.S. PATENT DOCUMENTS

| | | | |
|---|---|---|---|
| 1,638,806 | 8/1927 | Hilliard | 165/82 |
| 1,862,310 | 6/1932 | How | 165/82 X |
| 1,962,170 | 6/1934 | Blennerhassett . | |
| 1,994,779 | 3/1935 | McNeal | 165/82 X |
| 2,152,266 | 3/1939 | McNeal . | |
| 2,214,548 | 9/1940 | Chute et al. | 165/82 |
| 2,660,411 | 11/1953 | Weber | 165/70 |
| 2,859,948 | 11/1958 | Callard | 165/82 |
| 2,893,701 | 7/1959 | Bell | 165/70 X |
| 2,956,787 | 10/1960 | Raub | 165/82 |
| 3,114,415 | 12/1963 | Wintzer | 165/70 X |
| 3,301,321 | 1/1967 | Poore | 165/82 X |
| 3,465,727 | 9/1969 | Tidball | 165/70 X |
| 3,973,621 | 8/1976 | Bow et al. | 165/83 |
| 4,415,024 | 11/1983 | Baker . | |

FOREIGN PATENT DOCUMENTS

| | | | |
|---|---|---|---|
| 558913 | 7/1957 | Belgium | 165/82 |
| 2419780 | 9/1975 | Fed. Rep. of Germany | 165/82 |
| 1116426 | 5/1956 | France | 165/82 |
| 0041594 | 3/1982 | Japan | 165/82 |
| 219605 | 8/1968 | U.S.S.R. | 165/82 |
| 1015235 | 4/1983 | U.S.S.R. | 165/82 |

*Primary Examiner*—William R. Cline

[57] ABSTRACT

A high pressure heat exchanger assembly for a compressor having a shell and tube-type design. An elongated bundle assembly is received within the shell. The bundle assembly has a plurality of elongated tubes extending generally longitudinally through the shell. The tubes are securely affixed to fixed and floating tube sheet assemblies positioned at opposite ends of the shell. The fixed tube sheet assembly is securely attached to one end of the shell and the floating tube sheet assembly is allowed to float with respect to the other end of the shell. A seal between the floating tube sheet assembly and the end of the shell prevents the escape of internal fluids. Each tube sheet assembly is provided with an inner and outer tube sheet member separated by a plurality of spacers to create a vented space therebetween open to the outside atmosphere. The elongated tubes are sealingly press-fit within the inner and outer tube sheets of the fixed and floating tube sheet assemblies to provide a fixed connection therebetween. A plurality of spring devices are utilized to bias the floating tube sheet assembly towards the shell to counteract opposing internal shell pressure forces created within the shell assembly which may stress the press-fit tube-to-tube sheet connections.

6 Claims, 5 Drawing Figures

HEAT EXCHANGER ASSEMBLY FOR A COMPRESSOR

FIELD OF THE INVENTION

The invention relates generally to a heat exchanger assembly for a compressor and, more particularly, to a high pressure shell and tube type heat exchanger assembly having dual tube sheets, an axially expanding floating header assembly, and an expansion limiting feature for controlling the axial expansion of the floating header assembly due to internal pressure forces without preventing the normal thermal expansion of the tube bundle.

BACKGROUND OF THE INVENTION

In intercoolers employed in multi-stage centrifugal compressors, as well as in other related heat exchangers, gas introduced into the heat exchanger is caused to pass over coolant containing tubes whereby heat is transferred from the gas to the coolant with the gas being subsequently emitted through a discharge outlet.

One known embodiment of heat exchanger of the above-described type is disclosed in U.S. Pat. No. 4,415,024. An elongated cylindrical shell is provided with a gas inlet and a gas outlet and a rectangularly-shaped array of coolant tubes contained within a tube bundle. The tube bundle is fixedly attached to tube sheets at opposite ends of the shell. Typically, one tube sheet is rigidly held against the shell assembly by a fixed header assembly and the opposite tube sheet is connected to a floating header assembly which is allowed axial movement with respect to the shell assembly to allow for thermal expansion of the tube bundle relative to the shell assembly. The rigidly held tube sheet is provided with a gasket to seal between the tube sheet and shell assembly. The floating tube sheet and header assembly is usually provided with an O-ring seal to seal between the sliding header assembly and shell assembly flange. The coolant is introduced into the header assemblies to provide a flow of coolant through the tube bundle to cool the gas circulating through the shell assembly.

However, this design has certain limitations and is not particularly well suited for high shell pressure use. The sealed connections between the tube bundle and tube sheets can leak due to thermal stresses therebetween and/or by the interaction of the high pressure gas within the shell assembly acting on the tube sheet and seals. If leakage occurs, the gas and coolant mediums will be mixed thereby causing contamination of the mediums. Furthermore, the gasket between the floating header assembly and tube sheet can leak, providing an alternate contamination path mixing the two mediums.

It is, therefore, desirable to provide a heat exchanger assembly having a pair of tube sheets at each end of the tube bundle, the pair of tube sheets being spaced with said space being communicated exteriorly of the heat exchanger. Heat exchangers utilizing such a dual tube sheet design are not necessarily new in the industry. U.S. Pat. No. 2,152,266 to McNeal shows a heat exchanger utilizing dual tube sheets as described above. However, there is no provision contained therein limiting the axially expansion of the floating header assembly. In high shell pressure applications it is necessary to provide a counteracting force on the outer side of the floating header assembly and tube sheet to prevent the tube bundle from excessive axial movement due to internal shell pressure forces which can create harmful stresses between the tube bundle and tube sheet thereby breaking the fluid-tight container connections therebetween.

U.S. Pat. No. 1,962,170 to Blemerhassett shows a dual tube sheet design for a heat exchanger further utilizing a pressure balancing means to prevent pressure from within the shell to overly expand the tube bundle. This is accomplished by totally enclosing the floating header assembly and tube sheet within the shell to allow the high pressure fluid within the shell to act upon all sides of the floating assembly. However, to accomplish this and provide for dual tube sheets, a complex passage system must be provided to vent the space between the dual floating tube sheets. Furthermore, it is impossible to remove the floating header assembly from the tube sheet to clean or inspect the tube bundle without exposing the main shell casing to contaminates. And, if the gaseous medium is corrosive, a multiplicity of parts relating to the floating header assembly are subjected to corrosion and possible premature failure.

There remains a substantial need for an efficient heat exchanger such as shown in U.S. Pat. No. 4,415,024 which maintains the advantages described therein and which is adapted for use as a high pressure intercooler in centrifugal compressors, as well as in other environments, wherein double tube sheets are provided between the shell assembly and header assemblies providing a space therebetween to allow leakage from either fluid medium to escape exteriorly of the intercooler. Additionally, it is desirable to counter-balance the high pressure forces existing within the shell cavity acting on the floating tube sheet to prevent undue axial expansion of the tube bundle and floating tube sheet.

SUMMARY OF THE PRESENT INVENTION

The above-described need has been met by the present invention.

The present invention is an improved high pressure heat exchanger which includes an elongated shell having a supply end, a return end, fluid inlet and fluid outlet means and an elongated bundle assembly which has a plurality of longitudinally extending tubes. The inlet and outlet provide passage of a first fluid into and out of the shell representing the fluid medium to be cooled.

Dual tubing sheet assemblies are positioned at each of the supply and return ends of the shell to close in the ends of the shell space. The dual tube sheet assemblies each include an inner tube sheet and an outer tube sheet separated by a plurality of spacers to create an open space between the inner and outer tube sheets. The space is left substantially open to the atmosphere. The elongated tubes of the bundle assembly are received through both the respective inner and outer tube sheets of the return end tube sheet assembly and supply end tube sheet assembly. The tubes are sealingly affixed to each of the inner and outer tube sheets.

A supply header and a return header are fixedly connected to the outer tube sheets of the respective supply end tube sheet assembly and return end tube sheet assembly for communicating a second fluid through the elongated tubes of the tube bundle for cooling the first fluid medium. The open space between the respective inner and outer tube sheets directs any first or second fluids fluid escaping through or about the inner or outer tube sheets to the exterior of the heat exchanger assembly. The first and second fluid mediums are thereby isolated from each other preventing intermixing therebetween.

The heat exchanger assembly of the present invention also includes a floating tube sheet structure to allow for thermal expansion of the tube bundle as necessitated by the high pressures and high temperatures existing in the shell cavity. The assembly includes a floating return header assembly rigidly connected to the floating dual tube sheet which slidably seals against the shell flange. To counteract the high pressure forces existing in the shell cavity from overly expanding the floating tube sheet assembly to break the fluid-tight seals between the tubes and tube sheets, a retaining securing means is utilized for biasing the return header assembly toward the shell flange. The resilient retaining means includes a plurality of belleville washers or springs urging the return header towards the shell assembly upon application of an opposite force by the internal shell pressure forces acting on the inner face of the inner tube sheet.

It is an object of the present invention to provide a high pressure heat exchanger which utilizes double tube sheets to minimize the potential for mixing the two fluid mediums being processed through the heat exchanger.

It is another object of the present invention to provide a floating header design which allows the thermal expansion and limited high pressure induced growth of the tube bundle material relative to the shell assembly.

It is another object of the present invention to provide a floating header assembly having resilient retaining means to bias said assembly towards the shell to provide an opposing force acting towards the shell to counteract the internal high shell pressure forces acting on the interior of the floating tube sheet and relieve the stresses acting on the fluid-tight connections between the tubes and tube sheets created by the high pressure internal shell cavity forces.

It is another object of the present invention to provide a heat exchanger including a shell assembly and independent header assemblies, the assemblies being relatively separable for the purpose of cleaning and inspecting the tubes without exposing the interior of the shell assembly to contaminants.

These and other objects of the invention will be more fully understood from the following description of the invention with reference to the illustrations appended hereto.

DESCRIPTION OF THE PREFERRED EMBODIMENTS

Figure 1:
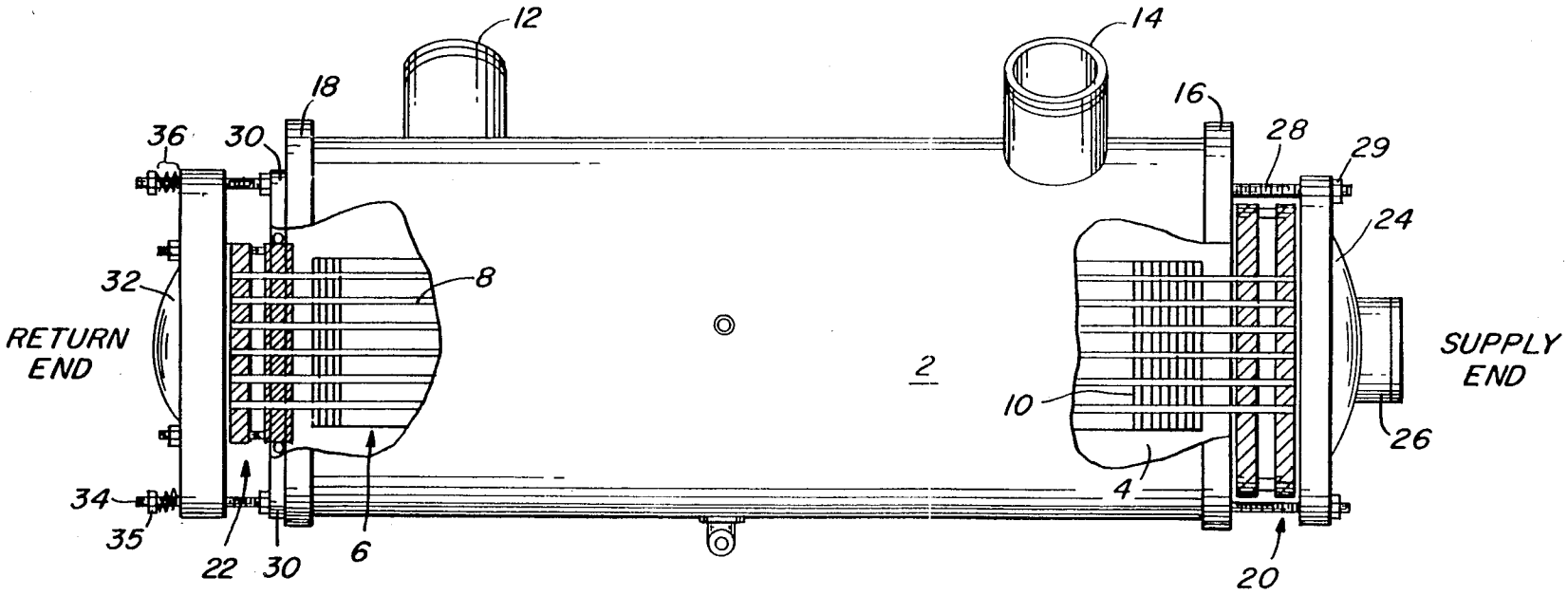
FIG. 1 is a side elevational view in partial cross-section of a heat exchanger assembly of the present invention.

Referring now to the drawings in more detail and initially to FIG. 1, there is shown a side elevational view in partial cross-section depicting generally the features of the present invention. An outer generally cylindrical shell casing is indicated by the reference number 2. An inner cavity of the shell within which the bundle assembly and associated components are received is generally indicated at 4. A bundle assembly 6 consists of a plurality of elongated tubes 8 which extend generally longitudinally within the bundle assembly and a plurality of transversely oriented fin plates 10 which are generally parallel to each other. Only a small number of tubes 8 have been shown in the drawings, however, in actuality, a large number of such tubes would exist in the bundle assembly 6. In operation of the heat exchanger, coolant flows through the tubes 8 and the gas to be cooled flows along the openings between adjacent fin plates 10. The gas would enter the shell 2 through a gas inlet 12 and discharge via gas outlet 14 longitudinally spaced from one another.

The particular flow path of the gaseous fluid passing through the shell portions of the heat exchanger are substantially similar to that shown in U.S. Pat. No. 4,415,024 assigned to the same assignee as the present invention. For further details concerning that flow path, reference is made to the above-named patent, the entire disclosure of which is incorporated herein by this reference.

FIG. 1 generally shows the structure of the outer shell 2. As can be seen on the right side of the drawing, shell 2 has an annular radially outwardly projecting flange 16 formed on outer shell 2. On the left side of FIG. 1, a similar flange 18 is shown formed with outer shell 2.

For ease of description, the right side of the cylindrical shell 2 and any further extending additions are generally labeled the supply end of the heat exchanger because typically the coolant medium will be supplied or attached to this end. The left side of the cylindrical shell 2 and any further extending additions appended thereto are generally referred to as the return end of the heat exchanger because here typically the shell will be sealed and structure added to permit the coolant to return to the supply end of the shell for removal.

As shown in FIG. 1, in partial cross-section the tube bundle 6 is positioned within the shell cavity 4 between first and second pairs of tube sheet assemblies 20 and 22, respectively. The elongated tubes 8 within tube bundle 6 extend longitudinally all the way through inner shell 4 beyond the dimensions of cylindrical flanges 16 and 18. The first tube sheet assembly 20 is located at the supply end of the shell 2 and receives the tubes 8 there through. The first tube sheet assembly is generally circular in cross-section and is of substantially larger cross-sectional area than the bundle assembly 6. A supply header 24 is received adjacent the first pair of tube sheets 20 which rigidly fixes or secures the tube sheets 20 to the supply end shell flange 16 by a plurality of studs 28 and nuts 29. Cooling fluid, such as water, is introduced in the supply header 24 through coolant inlet 26.

At the return end side of the shell 2 as shown in FIG. 1, an adapter flange 30 is provided adjacent to the cylindrical flange 18 and is fastened thereto. The adapter flange 30 is generally cylindrical about its outer perimeter and has a rectangular bore 31 therethrough generally conforming to the cross-sectional shape of the tube bundle 6. The second tube sheet assembly 22 located at the return end of the shell 2 is partially received within the adapter flange 30 which will be more fully described below. A return header 32 is connected to the outside of the return end tube sheet assembly 22 by use of a plurality of studs 34 and nuts 35. A resilient retaining means 36 is utilized to bias the return header 32 and tube sheet assembly 22 toward the adapter flange 30 and shell cavity 4 which will be more fully described below.

Figure 2:
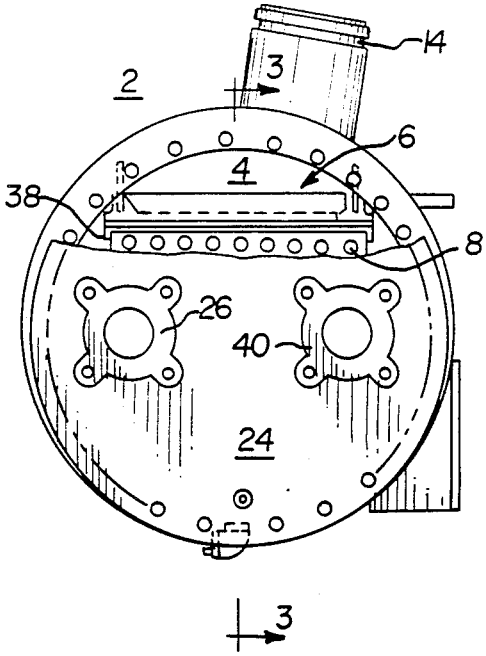
FIG. 2 is a partially broken away end elevational view of the supply end of the heat exchanger assembly shown in FIG. 1.

The bundle assembly 6 as shown in FIG. 2 has a substantially rectangular cross-sectional configuration as partially shown at 38. This configuration facilitates ease of manufacture, as well as ease of insertion and removal of the bundle assembly 6 from the shell 4. In addition, this configuration contributes to the efficiency of performance of the heat exchanger of the present invention as fully described in U.S. Pat. No. 4,415,024. The return end tube sheet assembly is also rectangular in configuration to conform generally with the cross-sectional shape of the tube bundle and inner perimeter of the adapter flange 30.

Referring to FIG. 2, there is shown a partially broken away view of the supply end of the heat exchanger assembly. Also shown is the coolant inlet 26 and coolant outlet 40, with the former serving to provide a fresh supply of cooling medium, such as water, and the latter serving to withdraw coolant at an elevated temperature after passing through the heat exchanger.

Figure 3:
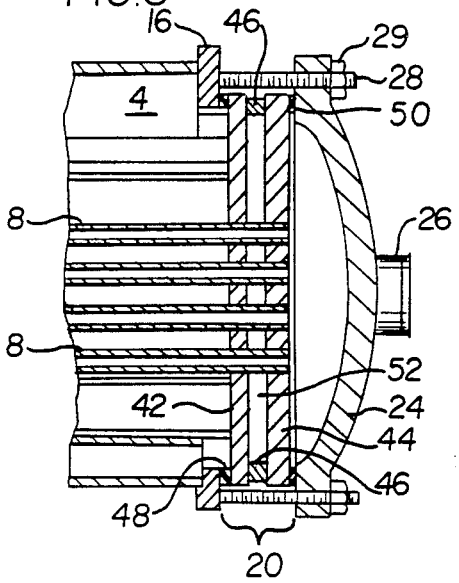
FIG. 3 is a fragmentary cross sectional view taken through 3—3 of FIG. 2.

Referring now to FIG. 3, the supply end of the heat exchanger is shown in more detail. The supply header 24 is secured to flange 16 by any suitable means and as shown here by studs 28 and nuts 29 positioned about the outer perimeter of the supply header 24.

The supply end tube sheet assembly 20 can now be clearly seen to be made up of an inner, generally cylindrical, tube sheet 42 positioned adjacent the front flange 16, and an outer, generally cylindrical, tube sheet 44. The inner and outer tube sheets 42 and 44, respectively, are separated by a plurality of spacers 46 which are affixed therebetween by any conventional method and as shown herein by welding. Inner and outer directions utilized herein denote a structure placed closer in a longitudinal direction to the inside of the shell assembly. An annular gasket 48 serves to provide a seal between the inner tube sheet 42 and the shell flange 16 to isolate the gaseous medium within the shell cavity 4. A second gasket 50 serves to provide a seal between supply header 24 and the outer tube sheet 44 when the studs 28 and nuts 29 are in a secured position.

The elongated tubes 8 of tube bundle 6 are sealed within both the inner and outer tube sheets 42 and 44, respectively. Typically, this connection is accomplished by inserting a special tool (not shown) into the tubes 8 to expand the diameter of the tubes within the dimensions of the inner and outer tube sheets 42 and 44. In this manner, a substantially fluid-tight seal is maintained between the tube sheets and elongated tubes.

A particularly important feature of the present invention is created by the provisions of the spacers 46 between the inner and outer tube sheets 42 and 44. A space 52 is created by use of spacers 46 which is vented to atmosphere such that if any of the fluid-tight joints between tubes 8 and the inner tube sheet 42 leaks, the gaseous fluid leaking thereby will be vented exteriorly of the heat exchanger. Similarly, if the fluid-tight joint between tubes 8 and the outer tube sheet 44 springs a leak, the coolant fluid leaking therethrough will vent exteriorly of the heat exchanger. In previous heat exchanger designs, such a leak between a tube and a tube sheet would allow mixing of the gaseous and coolant mediums thereby contaminating the gaseous or coolant mediums being discharged from the heat exchanger.

Figure 5:
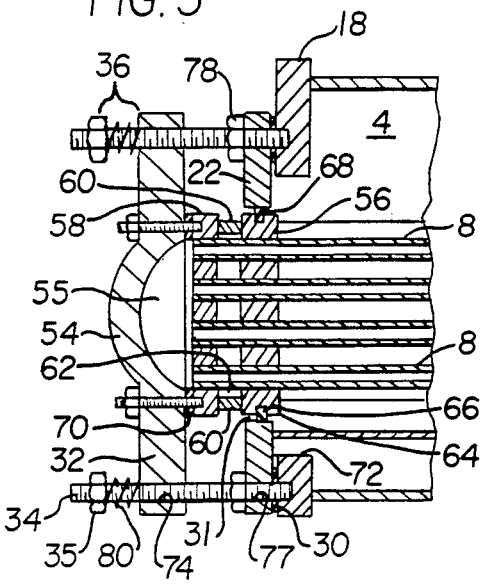
FIG. 5 is a fragmentary cross-sectional illustration taken through 5—5 of FIG. 4.
Figure 4:
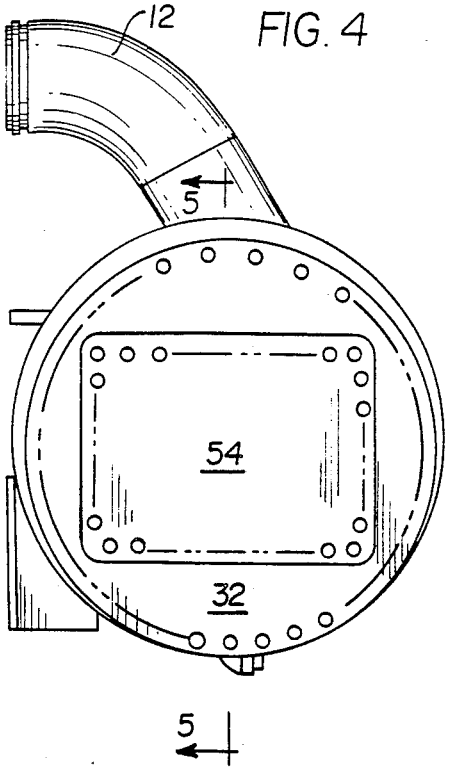
FIG. 4 is a end elevational view of the return end of the heat exchanger assembly shown in FIG. 1.

Referring now to FIGS. 4 and 5 in detail, further features of the invention will be considered. FIG. 4 shows a end elevational view depicting the return header 32. It will be appreciated from FIGS. 4 & 5 that the return end tube sheet assembly is generally 22 rectangular to conform with the generally cross-sectional shape of the tube bundle 6 and bore 31 of the adapter flange 30. The rectangular portion 54 of return header 32 represents a bulge in the header to provide a reservoir 55 between the header assembly 32 and tube sheet assembly 22 for receiving coolant from the supply header 24. The supply and return headers 24 and 32, respectively, usually have a number of baffles contained therein (not shown) for providing a particular coolant path through the shell assembly. Reference to U.S. Pat. No. 4,415,024 is made for a better understanding of the particulars of the coolant flow path.

Referring now to FIG. 5, which shows a fragmentary cross-sectional view of the return end of the heat exchanger, the particulars of a floating tube sheet assembly and resilient retaining means 36 are shown in detail. The return end tube sheet assembly shown at 22 include an inner tube sheet 56 and an outer tube sheet 58 separated by a plurality of spacers 60 to provide an open space 62 therebetween which is vented exteriorly of the heat exchanger. The spacers 60 are similarly welded to the tube sheets 56 and 58 as described in relation to spacers 46 utilized between inner and outer tube sheets 42 and 44 positioned at the supply end of the exchanger.

The elongated tubes 8 of the tube bundle 6 are received within both the inner and outer rear tube sheets 56 and 58. The tubes 8 are fixedly secured within both tube sheets 56 and 58 in a similar manner to that described above, relative to the supply end tube sheet assembly 20. Therefore, the distance between the first and second tube sheet assemblies 20 and 22, respectively, is initially predetermined and fixed. However, when a high pressure or high temperature gas is introduced within the fluid inlet 12 of shell 2 and an appropriate coolant is introduced through supply header 24 and tubes 8, the tube bundle 6 will expand and, subsequently contract under the thermal stresses created therein. The high pressure gas also acts on the inner faces of the two inner tube sheets 42 and 56 creating a force which pushes the two tube sheet assemblies 20 and 22 outwardly away from one another. It is, therefore, appreciated that it is necessary to provide the tube bundle 6 with a floating tube sheet and header assembly to help relieve the thermal stresses and high pressure growth caused by these interacting forces within the shell assembly.

As shown in FIG. 5, such a floating tube sheet design is provided in the present invention. The inner tube sheet 56 of the second tube sheet assembly 22 has a rectangular outer perimeter 64 which closely fits within the rectangular inner perimeter 31 of the adapter flange 30. The outer perimeter 64 of the inner rear tube sheet 56 has a groove shown at 66 to accept a finely machined O-ring 68 conforming generally to the inner perimeter of the adapter flange 30. O-ring 68 prevents the gaseous medium from escaping exteriorly of the shell assembly 2 while allowing the inner rear tube sheet 56 to expand axially with respect to the shell assembly 2.

The return header 32 is securely fastened to the outer rear tube sheet 58 by use of the studs 34 and nuts 35. A gasket 70 is positioned between header 32 and outer tube sheet 58 to provide a seal therebetween to prevent coolant from escaping from the return header assembly. It can be appreciated from FIG. 5 that if either the gasket 70, O-ring 68 or tube 8 to tube sheet 56 and 58 connections leak that any fluid emitting from either the shell cavity or header assembly reservoir will vent exteriorly of the heat exchanger due to the dual tube sheet design incorporated herein.

FIG. 5 also shows further details of the resilient retaining means 36 which slidingly biases the return header 32 toward the adapter flange 30 and shell flange 18. A plurality of axial bores 74 are placed through the return header 32 in a generally circular pattern to conform to similar bores 77 in the adapter flange 30. Studs 76 pass through said bores 74 and bores 77. Nuts 78 are received thereon to rigidly secure the adapter flange 30 to shell flange 18. A gasket 72 is provided to seal between shell flange 18 and adapter flange 30. The return header 32 also receives studs 76 through its bores 74. The return header 32 is secured to the outer tube sheet 58 via studs 34 and nuts 35. The return header 32 is then additionally held in place by a plurality of belleville washers or springs 80 which are secured on studs 74 by use of nuts 82.

The resilient attachment means 36 permits a slight preload to be applied against the return header 32. Th nuts 82 are rotated such that the belleville washers 80 apply a small pressure force against the return header 32, and, consequently, against the second tube sheet assembly 22 and tube bundle 6. The relationship between the floating tube sheet assembly 22 and tube bundle is important and must be critically controlled. In the initial installation of the washers 80 and nuts 82, it is desirable for the belleville washers 80 to apply a minimal amount of force biasing the return header 32 and floating tube sheet assembly 22 towards the shell assembly 2. Upon the introduction of a high pressure gaseous fluid within shell cavity 4, the floating tube sheet assembly 22 will be expanded outwardly away from the fixed tube sheet assembly 20 in reaction to the high pressure fluid interacting on the cross-sectional area of the inner face of the inner tube sheet 56. The return header 32 is rigidly connected to the outside of the second or floating tube sheet assembly 22 and, therefore, it will also expand outwardly with the floating tube sheet assembly 22 to compress the belleville washers 80 of the resilient retaining means 36. A spring force is applied back onto the return header 32 which is opposite to the high pressure force applied to the inner face of the inner rear tube sheet 56. Therefore, the high pressure forces within the shell assembly acting on the tube sheet and tube bundle are minimized. Otherwise, the high internal pressures existing within the shell cavity 4 would cause the floating tube sheet assembly 22 to expand outwardly faster than the thermal expansion of the elongated tubes 8 thereby breaking the fluid-tight seals between tubes 8 and tube sheets 56 and 58 of the floating tube sheet assembly 22. It is important that the spring force be large enough to counteract the high pressure forces existing in the shell cavity 4, but not sufficient to prevent normal thermal expansion of the tube bundle 6 created by extreme temperature differentials between the gaseous and coolant mediums.

The use of an external reaction force is advantageous because it allows the floating return header to be located externally to the shell assembly and pressures. Furthermore, the metal parts of the return header 32 are protected from a possibly corrosive gaseous fluid medium.

It will be appreciated that the heat exchanger assembly of the present invention may advantageously function as a high-pressure intercooler in a multi-stage centrifugal compressor, as well as functioning in a wide range of environment wherein cooling of gaseous media is desired.

It will be appreciated, therefore, that the present invention provides a double tube sheet design which minimizes the potential for mixing the gaseous and coolant mediums through the heat exchanger. Any leaks between the gaskets, seals or tube to tube sheet connections will be vented to atmosphere. Such features allows for early detection of any such leaks allowing for less machine down time and loss of efficiency created by such leaks. Furthermore, the return and supply headers may be removed so that the tubes 8 can be cleaned and/or inspected without opening the shell cavity 4 to atmosphere and possible contaminants.

It will be further appreciated that the present invention provides a floating return header and tube sheet assembly which allows for thermal expansion of the tube bundle, as well as limited high pressure expansion of the floating tube sheet assembly without over-stressing the connections between the tubes and tube sheets in an undesirable manner.

It will be further appreciated that the present invention provides a resilient retaining means for interacting on the return header and floating tube sheet assembly to help relieve the high pressure forces acting against the inner face of the tube sheets. The counteracting spring force acts in the opposite direction to the pressure expanding force to minimize the pressure stresses acting on the tube sheets and tube bundle thereby, protecting the tube to tube sheet connections.

Whereas, particular embodiments of the invention have been described above, for purposes of illustration, it will be evident to those skilled in the art that numerous variations of the details may be made without departing from the invention as defined in the appended claims.

What is claimed is:

1. A heat exchanger assembly for a compressor comprising:

an elongated shell having first and second flanged ends, a fluid inlet and fluid outlet, said inlet and outlet providing passage of a first fluid into and out of said shell;

a fixed tube sheet assembly positioned adjacent the first flanged end of said shell, said fixed tube sheet assembly having a fixed inner tube sheet sealingly affixed to the first flanged end to close in the first end of the shell space and a fixed outer tube sheet spaced from the fixed inner tube sheet, the fixed inner and outer tube sheets being separated by a plurality of spacers to create a substantially open space therebetween in communication with the exterior of said heat exchanger assembly;

a floating tube sheet assembly positioned adjacent the second flanged end of said shell, said floating tube sheet assembly having a floating inner tube sheet sealingly abutting the second flanged end to close in that end of the shell space and a floating outer tube sheet spaced from the floating inner tube sheet, the floating inner and outer tube sheets being separated by a plurality of spacers to create a substantially open space therebetween in communication with the exterior of said heat exchanger assembly, said floating tube sheet assembly being allowed limited longitudinal movement with respect to the second flanged end of said shell without breaking the sealed abutment between the floating inner tube sheet and said second flanged end;

an elongated tube bundle assembly received within said shell, said bundle assembly having a plurality of elongated tubes extending generally longitudinally within said bundle assembly and being received through both of the inner and outer tube sheets of said fixed and floating tube sheet assemblies, each of said tubes being affixedly press-fit into the inner and outer tube sheets providing a fixed fluid-tight connection with each of the inner and outer tube sheets of said fixed and floating tube sheets, respectively; and fixed and floating header assemblies being affixed to the fixed and floating outer tube sheets, respectively, for providing passage of a second fluid to be communicated through the elongated tubes extending through said shell such that if the first fluid within the shell or the second fluid within said tubes and header assemblies leaks by the sealed connections between said tubes and the fixed and floating tube sheet assemblies, the escaping fluid will pass into the open spaces between said fixed and floating tube sheet assemblies, respectively, to be vented exteriorly of said heat exchanger assembly without the possibility of intermixing the first and second fluids within said heat exchanger assembly.

2. The heat exchanger assembly of claim 1 further comprising a resilient retaining means positioned outside the floating header assembly for biasing the floating header assembly and floating tube sheet assembly towards the interior of said shell to counteract opposing internal shell pressure forces acting on the inside of the inner floating tube sheet, said resilient retaining means having a plurality of studs connecting to the second flanged end and extending longitudinally away from said shell, the floating header assembly having a plurality of bores receiving said studs therethrough, said resilient retaining means further including a plurality of nuts positioned on the free ends of the studs and a plurality of spring means positioned about the studs between the nuts and floating header assembly for biasing said floating header assembly towards said shell such that as the internal pressures within the shell increase, the greater the spring means will be compressed which, consequently, increases the opposite biasing force the spring means exerts upon said floating header assembly and second floating tube sheet assembly.

3. The heat exchanger assembly of claim 2 wherein the spring means comprises a plurality of belleville washers, a belleville washer surrounding each of the studs between the nuts and floating header assembly.

4. A heat exchanger assembly for a compressor comprising:

an elongated shell having first and second flanged ends, a fluid inlet and fluid outlet providing passage of a first fluid into and out of said shell;

a fixed tube sheet assembly positioned adjacent the first flanged end of said shell, said fixed tube sheet assembly having a fixed inner tube sheet member sealingly affixed to the first flanged end to close in the first end of the shell space and a fixed outer tube sheet member spaced from the fixed inner tube sheet member, the fixed inner and outer tube sheet members being separated by a plurality of spacers to create a substantially open first space therebetween in communication with the exterior of said heat exchanger assembly;

a floating tube sheet assembly positioned adjacent the second flanged end of said shell, said floating tube sheet assembly having a floating inner tube sheet member sealingly abutting the second flanged end to close in that end of the shell space and a floating outer tube sheet member spaced from the floating inner tube sheet member, the floating inner and outer tube sheet members being separated by a plurality of spacers to create a substantially open second space therebetween in communication with the exterior of said heat exchanger assembly, the floating tube sheet assembly being allowed limited longitudinal movement with respect to the second flanged end of said shell without breaking the sealed abutment between the floating inner tube sheet member and said second flanged shell end;

an elongated tube bundle assembly received within said shell, said bundle assembly having a plurality of elongated tubes extending generally longitudinally within said bundle assembly and being received through both of the inner and outer tube sheet members of the fixed and floating tube sheet assemblies, each of said tubes being securely affixed within the inner and outer tube sheet members of the fixed and floating tube sheet assemblies, respectively, to provide a press-fit sealed connection therebetween;

a header assembly being affixed to each of the fixed and floating outer tube sheet members for providing passage of a second fluid to be communicated through the elongated tubes extending through said shell whereby if the first fluid leaks by the sealed connections between the tubes and inner tube sheet members or the second fluid leaks by the sealed connections between the tubes and outer tube sheet members, the escaping first or second fluids will pass into the first and second open spaces between the fixed and floating tube sheet asemblies, respectively, to be vented exteriorly of said heat exchanger assembly without intermixing the first and second fluids within the heat exchanger assembly; and a resilient retaining means positioned adjacent the floating header asembly for biasing the floating header assembly and floating tube sheet assembly towards the interior of said shell to counteract opposing internal shell pressure forces acting on the inside of the inner floating tube sheet member.

5. The heat exchanger assembly of claim 4 in which said resilient retaining means comprises:

the second flanged end of said shell having a plurality of studs attached thereto and extending in a longitudinal direction outwardly away from the flanged end;

the floating header assembly having a plurality of bores receiving the studs therethrough;

a plurality of nuts positioned on the free ends of the studs; and a plurality of spring means positioned about the studs between the nuts and floating header assembly for biasing the floating header assembly towards said shell such that as the internal fluid pressures within said shell increase to move the floating header assembly outwardly in a longitudinal direction of said shell, the greater the spring means will be compressed which, in turn, increases the biasing force exerted by the spring means upon the floating header assembly and floating tube sheet assembly towards said shell to prevent the tube to tube sheet member connections from being overstressed.

6. The heat exchanger of claim 5 wherein the spring means comprises a plurality of belleville washers, a belleville washer surrounding each of the studs between the nuts and floating header assembly.

* * * * *